US005626419A

United States Patent [19]

Lin

[11] Patent Number: 5,626,419

[45] Date of Patent: May 6, 1997

[54] STRUCTURE OF CHRISTMAS LIGHT

[76] Inventor: Mei M. Lin, Suite 1, 11F, No. 95-8, Chang Ping Road., Sec. 1., Taichung, Taiwan

[21] Appl. No.: 351,575

[22] Filed: Nov. 21, 1994

Related U.S. Application Data

[63] Continuation of Ser. No. 126,513, Sep. 27, 1993, abandoned.

[51] Int. Cl.[6] ..... H01R 4/24

[52] U.S. Cl. ..... 362/391; 362/249; 439/419

[58] Field of Search ..... 362/227, 236, 362/249, 391, 457, 806; 439/414, 419, 444, 600, 601, 602, 603, 611, 615, 617, 619, 662, 733

[56] References Cited

U.S. PATENT DOCUMENTS

| | | | |
|---|---|---|---|
| 3,609,643 | 9/1971 | Connan | 439/419 |
| 4,870,548 | 9/1989 | Beachy et al. | 439/414 |
| 5,228,774 | 7/1993 | Liao | 362/391 |
| 5,350,315 | 9/1994 | Cheng et al. | 439/419 |
| 5,366,386 | 11/1994 | Liao | 439/419 |
| 5,380,215 | 1/1995 | Huang | 439/419 |
| 5,389,008 | 2/1995 | Cheng et al. | 439/419 |

*Primary Examiner*—Ira S. Lazarus
*Assistant Examiner*—Sara Sachie Raab

[57] ABSTRACT

An improved structure of Christmas light mainly includes a bottom base, a light stand as well as an alterable lamp holder. There is further a pair of first and second copper conductors, each having several triangular barbs laterally formed in order to prevent the copper conductors from moving away from the light stand and causing a short circuit. The copper conductor further has an end tip point reinforced with a groove so as to effectively puncture into the electric wires without increasing its thickness saving material cost. Taking advantage of a detachable light stand the lamp holder may desirably be changed to various lamp holders of different shapes to acheive a cosmetic effect. Furthermore, due to the structure of the vertical pole on a bottom base which has an inverted fastening head longer than that of the prior art a linking effect in snap fitting results.

3 Claims, 5 Drawing Sheets

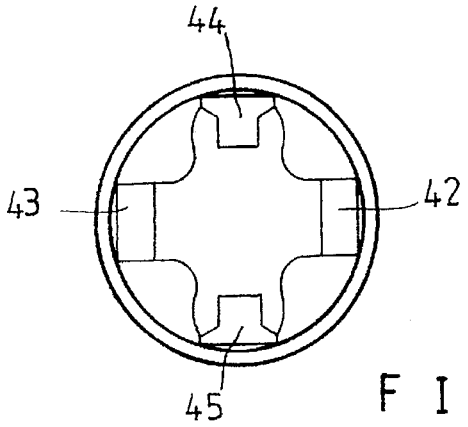
FIG. 5
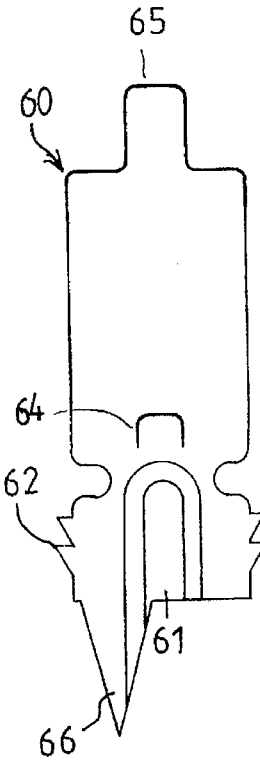
FIG. 7
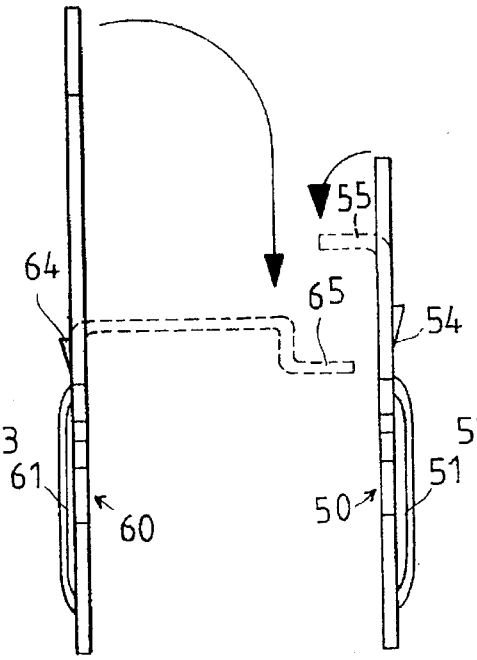
FIG. 7A
FIG. 6A
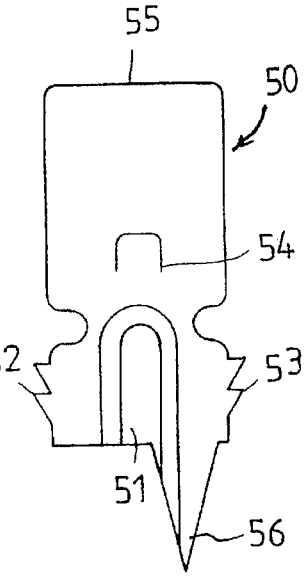
FIG. 6
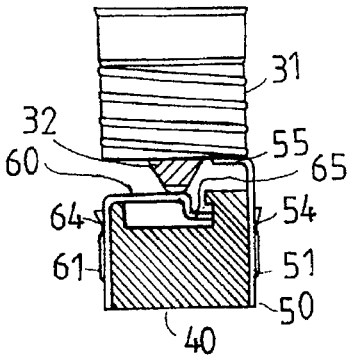
FIG. 8

STRUCTURE OF CHRISTMAS LIGHT

FIELD OF THE INVENTION

This is a continuation of U.S. patent application Ser. No. 08/126,513, filed on Sep. 27, 1993, now is abandoned.

The present invention relates to Christmas lighting, and more particularly to an improved structure of Christmas light which light stand and lamp holder are detachable and comprise a triangular barb and a groove reinforced of copper conductor on both wings which can create a relatively practical and good operation effect.

BACKGROUND OF THE INVENTION

Prior art Christmas lights include a bottom base as illustrated in FIGS. 1 and 2, a light stand 20, and a light bulb 30. Two vertical poles 11 and 12 are projected on the opposite sides of the bottom base 10, and two fasteners 13 and 14 are bent at the inner sides of both vertical poles. Holders 15 and 16 are used to hold a pair of cable wires 18, are formed oppositely between both vertical poles, and facilitate two copper puncture conductors 19 and 19' to connect. A hang hook 17 is placed at a position below the bottom base 10. A light stand 20 is disposed on the bottom base 10. A cable slot 21 is placed under the light stand 20 opposite to the holders 15 and 16 and sockets for the copper conductors 19 and 19' are formed in the light stand 20 (not illustrated). The copper conductors 19 and 19' each has a protruberance 191 and 191' formed on the upper section and a point 192 and 192' at the bottom. One of them is vertically disposed and the other is bent to a flat portion, so as to form a ring contact and a tip contact for an incandescent bulb 30 as it engages within the socket of the light stand 20 (as shown in FIG. 3). The points 192 and 192' of both copper conductors 19 and 19' are installed using a puncturing connection with the pair of electric wires respectively in order to light the bulb 30. As shown in FIGS. 1, 2, and 3, some shortcomings of prior art Christmas lights are outlined as follows: (1) In production, the nicety of the abovementioned Christmas lights habitually used disappears because of manipulation negligence, resulting because the copper conductors may be deformed, the ring contact may become flat or the tip contact may become vertical. Thus, two conditions like that will equally bring about a short circuit. (2) It is impossible to alter lamp holder to another shape for cosmetic purposes.

SUMMARY OF THE INVENTION

The main object of the present invention is to provide an improved structure of Christmas light which has a pair of copper conductors formed with several triangular barbs and a puncturing point reinforced by a groove thereon. Thus, increasing the intensity for puncturing electric wires and achieving a linking effect of security and handiness. The present invention provides a variety of lamp holders, with more choices in terms of the assembling effectiveness.

BRIEF DESCRIPTION OF THE DRAWINGS

FIG. 5 is a top view of a light stand of the preferred embodiment according to the present invention.

FIGS. 6 and 6A are the front and end views of the first copper conductor of the preferred embodiment according to the present invention.

FIGS. 7 and 7A are the front and end views of the second copper conductor.

FIG. 8 is a sectional front view, showing the connection of the conductors with the lamp holder and the light stand.

DETAILED DESCRIPTION OF THE PREFERRED EMBODIMENT OF THE PRESENT INVENTION

Figure 1:
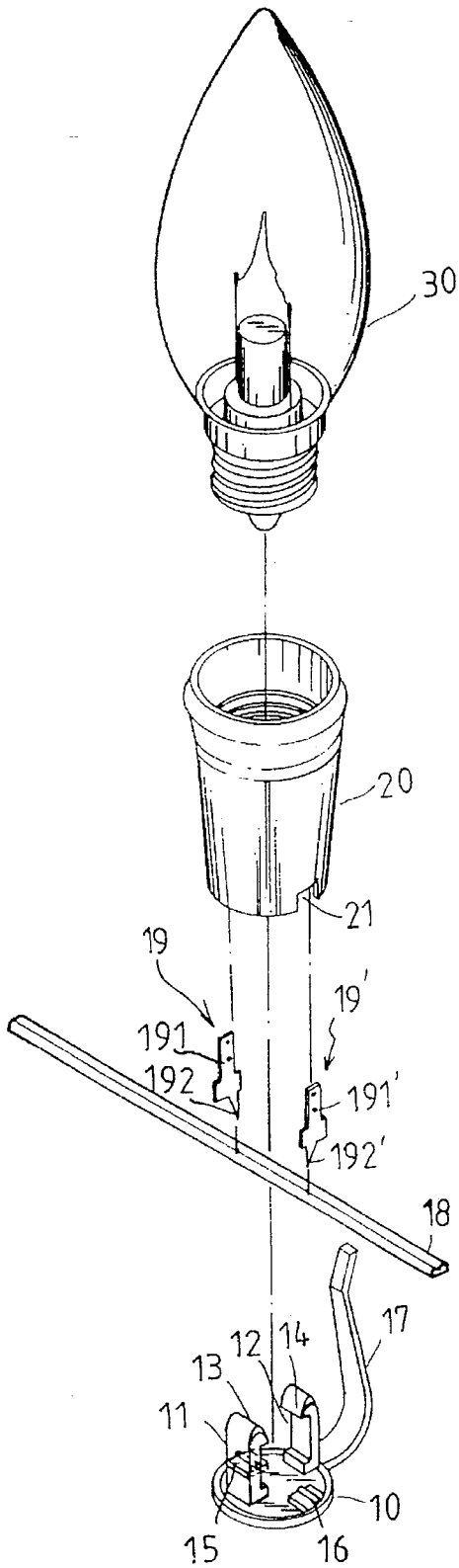
FIG. 1 PRIOR ART
FIG. 1 is a perspective exploded view of a prior art.
Figure 3:
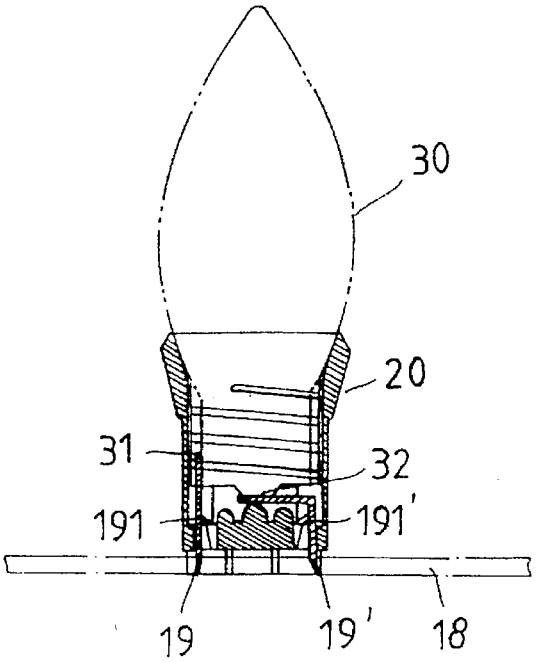
FIG. 3 PRIOR ART
FIG. 3 is a sectional view of the prior art.
Figure 2:
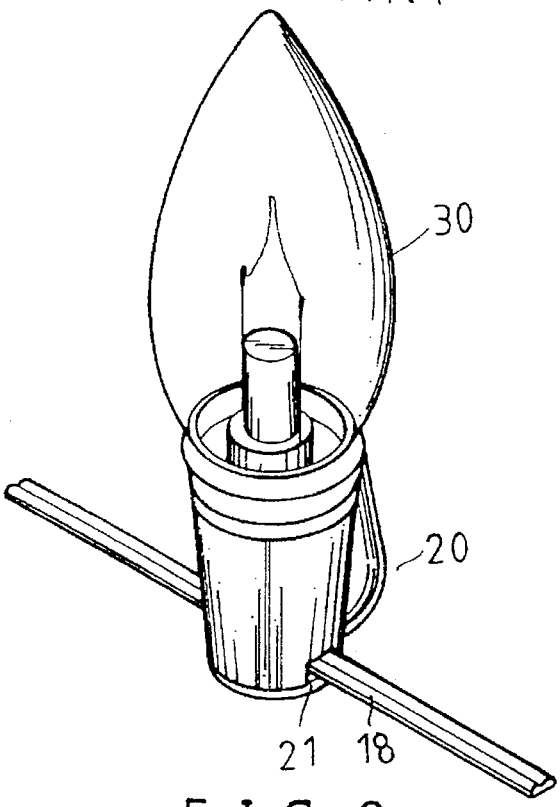
FIG. 2 PRIOR ART
FIG. 2 is a perspective view of the prior art.
Figure 4:
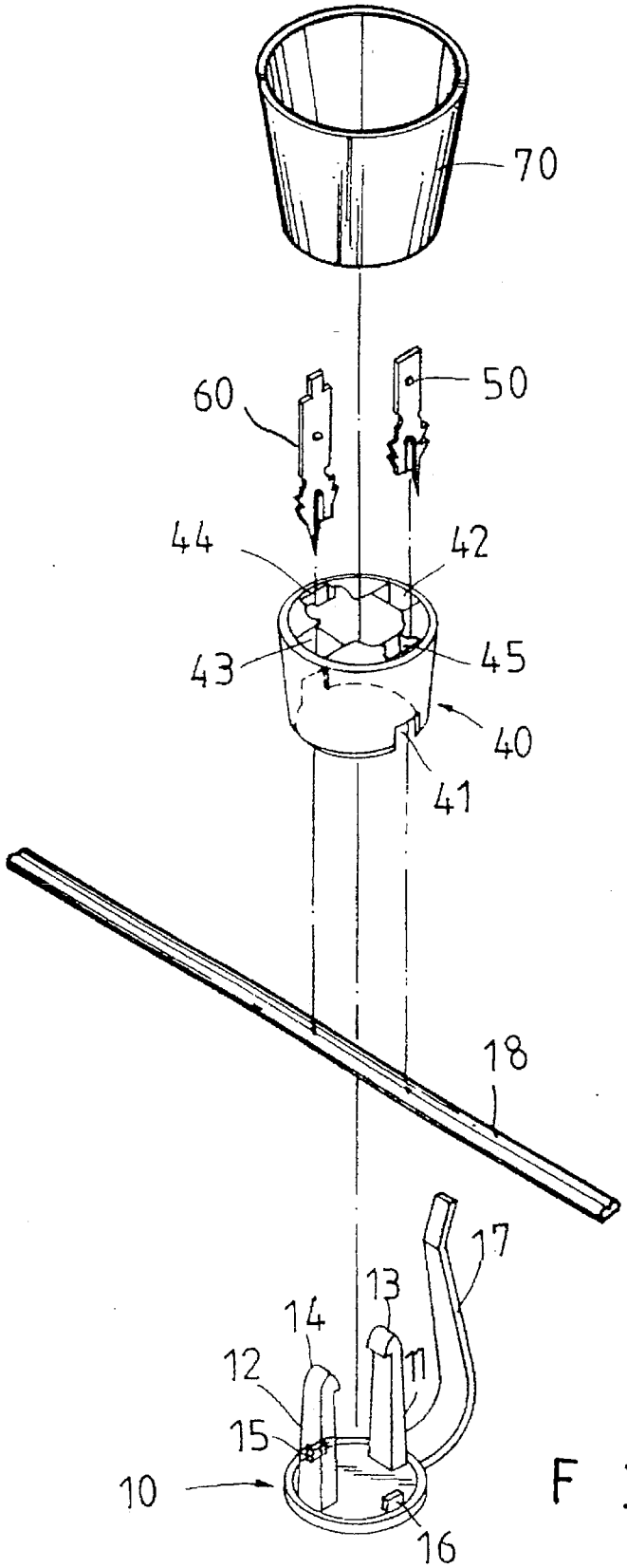
FIG. 4 is a perspective exploded view of a preferred embodiment according to the Present invention.
Figure 9:
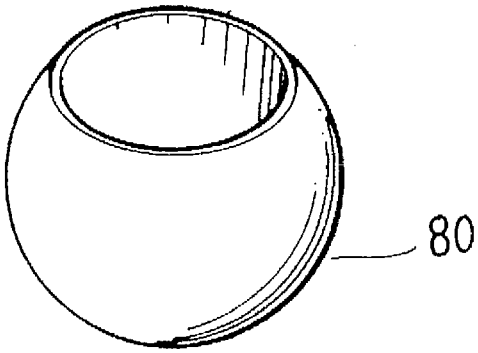
FIG. 9 is a perspective view of the lamp holder of alternative shape.
Figure 10:
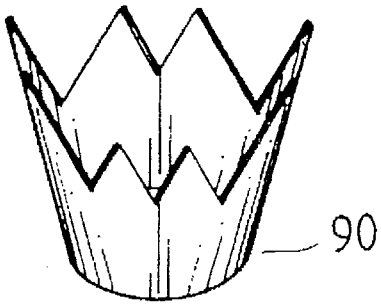
FIG. 10 is a perspective view of the lamp holder of another alternative shape.

Please refer to FIGS. 4 and 5, an improved structure of Christmas lighting comprises a bottom base 10, a light stand 40, a first copper conductor 50, a second copper conductor 60, and the lamp holders which can be different in shape, a globe or a crown as illustrated by numerals 70, 80, or 90 in FIGS. 4, 9 and 10. The bottom base 10 has a pair of, vertical poles 11 and 12 relevantly projected upward from the circumference thererof at symmetrical positions, a hook 17 extended outward from a circumferential edge in addition to a pair of supports 15 and 16 which are symmetrically located between vertical poles 11 and 12. The vertical poles 11 and 12 each form an inverted fastening head 13 and 14 longer than the conventional ones in order to insert through the light stand 40 and the holder 70, 80, or 90 when fastening. The bottom of the light stand 40 provides a pair of accommodating slots 41 to let a pair of cable wires 18 to pass through. Two vertical wedge recesses 42 and 43 symmetrically are formed at the two opposite edges and through the body of the light stand 40 for respectively retaining the vertical poles 11 and 12 of the bottom base 10 therein during a snapping coupling. Additionally, upon a perpendicular bisector between the wedge recesses 42 and 43, two symmetrical vertical sockets 44 and 45 of T-shape are provided so that the first copper conductor 50 and the second copper conductor 60 can be inserted therethrough respectively. As shown the FIGS. 6 and 6A, the first copper conductor 50 has been formed an end tip point 56, a reinforced groove 51 and a pair the edge barbs 52 and 53 pointed upwardly on the two edges of the bottom section respectively and a side barb 54, pointed upward on the appropriate center of the upper section 55 thereof. Further refer to FIGS. 7 and 7A, the second copper conductor 60 on the bottom section also forms an end tip point 66, a reinforced groove 61, a pair of the edge barbs 62 and 63, and a side barb 64 located at a position as the side barb 54 on the first copper conductor 50. But the upper section 65 of the second copper conductor 60 is longer than that of the first copper conductor 50, in addition to a narrow strip 65 centrally extended from the upper end,the upper section 65 will be bent to form a tip contact at a later stage.

Accordingly, the first and second copper conductors 50 and 60 must be inserted into the two vertical sockets 44 and 45 of light stand 40 respectively, while assembling. On the one hand, that makes the tip point of each copper conductor 50 or 60 protrude at the bottom of the light stand 40; on the other hand, the barbs 52, 53, 54, 62, 63, and 64 make each copper conductor capable of tightly fastening when plugged in the sockets 44 and 45.

Then the rectangular upper section 55 of the first copper conductor 50 is bent laterally to form a perpendicular flat board as a ring contact for enabling the engagement with a first contact part 31 of the incandescent bulb 30. The rectangular upper section 65 of the second copper conductor 60 is similarly bent to form a longer flat board which is further bent into three bends until its end section becomes a U-shape tip contact engaging with the second contact part 32 of the incandescent bulb 30 as shown in FIG. 8 Since each copper conductor 50, 60 is equally formed with the rein! forced grooves 51 and 61, they can avoid damage while plugging. After each copper conductor 50 and 60 has been fixed into their respective sockets 44 and 45, the pair of cable wires 18 are placed on the pair of supports 15 and 16 which are disposed on the two opposing sides of the bottom base 10 between the two vertical poles 11 and 12 respectively. The two vertical poles 11 and 12 of the bottom base 10 are then inserted through the two vertical wedge recesses 42 and 43 of the light stand 40 for a snap connection therein. Thus, the end tip points 56 and 66 of first and second copper conductors 50 and 60 each punctures one side of the pair of cable wires respectively to achieve an electrical contact between the wires 18 and the incandescent bulb 30. The lamp holder 70, for securing the incandescent bulb 30, is connected with the light stand 40 by means of snap fitting or bayonet type of securement. The vertical poles 11 and 12 should be long enough to plug through the light stand 40 and enable the fastening heads 13 and 14 to fasten with the lamp holder 70. The shape of lamp holder can be a general shape of the lamp holder 70 as shown in FIG. 4, a globe shape lamp holder 80 as illustrated in FIG. 9 or a Crown shape of lamp holder 90 as shown in FIG. 10 Since the lamp holder and the light stand 40 are not made in one piece, lamp holders of various shapes are changeable according to the user's desire. Further referring to FIG. 8, the present invention is handy to save manpower in assembling because the first and second copper conductors 50 and 60 are inserted downwardly.

Furthermore, due to the practical design of reinforced grooves 51 and 61 being equally formed on first and second copper conductors 50 and 60 the conductors will not lose their nicety, because of negligence, mechanical fault, abnormal bending, or further because of short circuit of the first and second copper conductors 50 and 60. In other words, ineffectiveness of the present inventions may reduced to a minimum, therefore, saving quality control manpower.

The scope of this invention should be determined by the appended claims and their legal equivalents rather than by the aforediscussed embodiment.

I claim:

1. A structure of Christmas light comprising a bottom base, a light stand and a lamp holder mutually connected by means of snap fitting;

said bottom base comprising a pair of vertical poles perpendicularly and upwardly projected from opposing sides thereof having each a means for snap fastening formed at an upper end thereof, a pair of support means protruded at another opposing side between said vertical poles and a hook means attached to a periphery thereof;

said light stand comprising a pair of slots symmetrically formed at opposing sides of a bottom edge thereof for passage of a pair of electric wires, a pair of the vertical wedge recesses symmetrically formed at opposing edges thereof for respectively retaining said vertical poles therein and a pair of the T-shape cross-section vertical sockets symmetrically formed at another opposing edges thereof bisecting between said pair of wedge recesses;

a pair of the first and second copper conductors:

said first copper conductor comprising a tip point at one end abutting a reinforcement groove, a plurality of triangular barbs respectively formed on lateral sides and flat side thereof and a rectangular upper section which is bent transversely to form a ring contact;

said second copper conductor comprising said a tip point at one end abutting a reinforcement groove, a plurality of triangular barbs respectively formed on lateral sides and a flat side thereof and a rectangular upper section including a narrow strip extended from a free end thereof which is then bent transversely into an U-shape to form a tip contact;

said first and second copper conductors being inserted into said respective T-shape vertical sockets of said light stand and retained therein by said barbs thereon with said tip points thereof protruded out of said light stand;

whereby, said bottom base is connected to said light stand together with said pair of electric wires disposed on said pair of support means thereof and retained by said vertical poles inside said wedge recesses of said light stand in a snap fitting, wherein said pair of electric wires are punctured by said tip points of said first and second copper conductors respectively for communication of electric power between said wires and an incandescent bulb which is engaged therewith after said lamp holder is connected to said light stand.

2. A structure of Christmas light as recited in claim 1, wherein said lamp holder is in a globe shape.

3. A structure of Christmas light as recited in claim 1, wherein said lamp holder is in a crown shape.

* * * * *